United States Patent [19]

Honda

[11] Patent Number: 5,039,110

[45] Date of Patent: Aug. 13, 1991

[54] ARROW FLETCHING

[76] Inventor: Shig Honda, 11154 Telfair Ave., Pacoima, Calif. 91311

[21] Appl. No.: 563,513

[22] Filed: Aug. 6, 1990

[51] Int. Cl.[5] ..... F42B 6/06

[52] U.S. Cl. ..... 273/423

[58] Field of Search ..... 273/423, 420

[56] References Cited

U.S. PATENT DOCUMENTS

| | | | |
|---|---|---|---|
| 1,842,540 | 1/1932 | Cowdery | 273/423 |
| 2,193,397 | 3/1940 | Dykes | 273/423 |
| 2,830,818 | 4/1958 | Otto | 273/423 |
| 2,887,319 | 5/1959 | Lay | 273/423 |
| 3,595,579 | 7/1971 | Benoit | 273/423 |
| 3,895,802 | 7/1975 | Bear | 273/423 |
| 3,922,401 | 11/1975 | Bear | 273/423 X |
| 4,012,043 | 3/1977 | Carella | 273/423 |
| 4,088,323 | 5/1978 | Munger | 273/423 |
| 4,392,654 | 7/1983 | Carella | 273/423 |
| 4,502,692 | 3/1985 | Humphrey | 273/423 |

*Primary Examiner*—Paul E. Shapiro

*Attorney, Agent, or Firm*—Elliott N. Kramsky

[57] ABSTRACT

An arrow includes a plurality of fletchings of sheet-like, substantially planar composition that, when engaged to the cylindrical arrow shaft, acquire aerodynamic curvatures. Each fletching includes a symmetrical arcuate edged vane. The ends of the arcuate edge terminate at a strip-like base that is coated with a double-sided adhesive for fixing the fletching to the arrow shaft. The fletchings are spaced regularly about the shaft and mounted tangential to its periphery to provide a stiff design that allows the flight of the arrow to take place substantially unimpeded by flutter accumulation.

2 Claims, 1 Drawing Sheet

FIG. 5
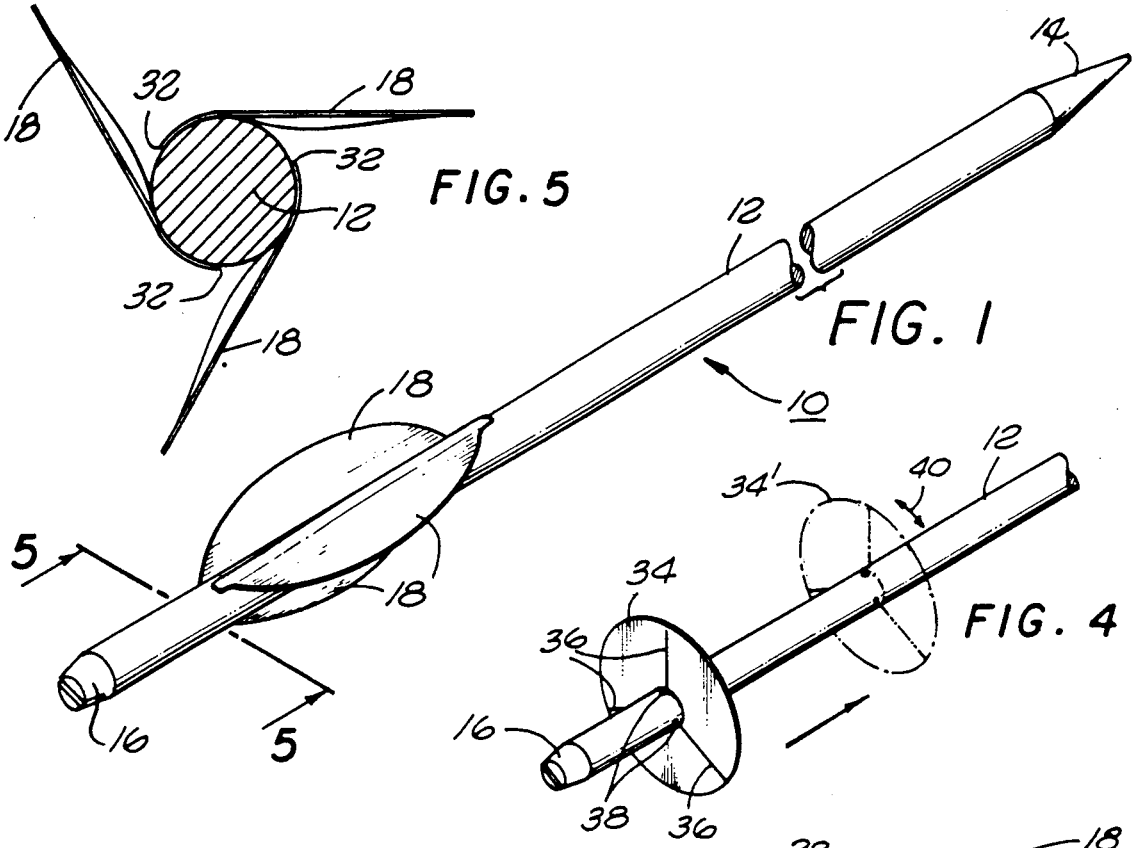
FIG. 1
FIG. 4
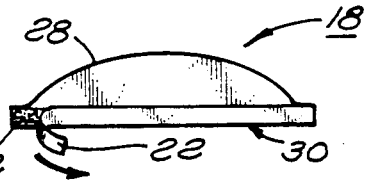
FIG. 3
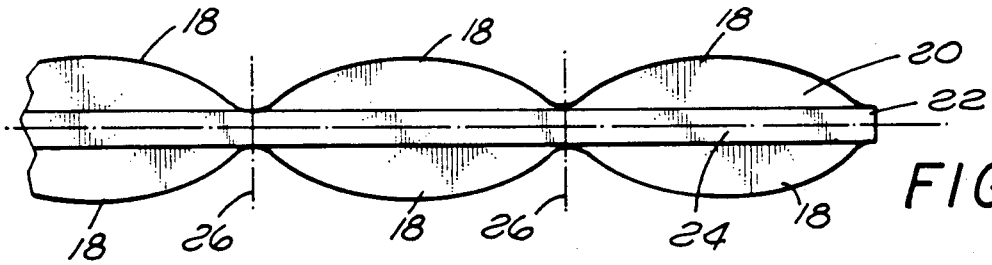
FIG. 2
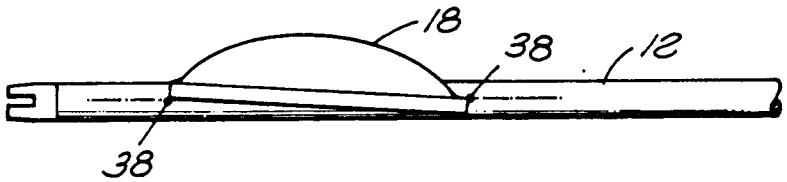
FIG. 6A
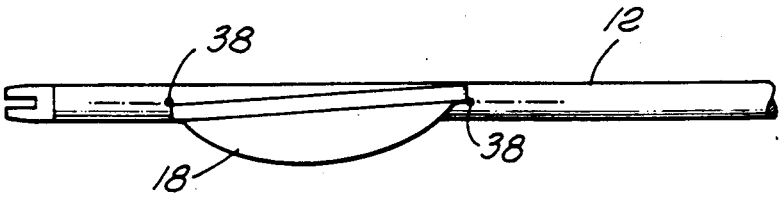
FIG. 6B

ARROW FLETCHING

BACKGROUND

1. Field of the Invention

The present invention relates to apparatus for stabilizing the flight of an arrow. More particularly, this invention pertains to an improved fletching that is particularly useful for controlling a lightweight, high speed arrow of the type employed in competitive archery.

2. Description of the Prior Art

Fletchings are conventionally mounted to the rear end of an arrow to provide flight stability, three or four of such fletchings being equally spaced about the periphery of the arrow's shaft. Historically, feathers have provided the recognized fletching material for use by archers. More recently, synthetic plastic fletchings have gained acceptance. This innovation has opened a range of opportunities for creative design not formerly possible.

Archery has also experienced a "materials evolution" in terms of arrow fabrication. While arrows of both aluminum and wood composition have been known and used competitively for many decades, recent times have witnessed the advent of high speed, light weight arrows of carbon composition While such arrows provide many potential advantages for the archer, so-called "flutter" or instability at long distances has been observed by top-notch archers when using carbon shaft arrows.

SUMMARY AND OBJECTS OF THE INVENTION

It is therefore an object of the invention to provide an improved fletching that is particularly advantageous when adapted to high-speed, light weight arrows of the carbon type.

A further object of this invention is to attain the above object with a fletching that is simple both to manufacture and install.

The present invention achieves the above objects and others by providing an arrow that includes a substantially cylindrical shaft with front and rear ends and a plurality of fletchings fixed thereto adjacent its rear end. Each of the fletchings has a generally symmetrical, arcuate shape that extends from a substantially straight bottom edge. The strip-like base extends beyond the arcuate shape.

The foregoing and additional features and advantages of this invention will become further apparent from the detailed description that follows. This written description is accompanied by a set of drawing figures. Numerals of the written description, corresponding to those of the drawing figures, point to the features of the invention. Like numerals refer to like features throughout both the illustration and the written description.

BRIEF DESCRIPTION OF THE DRAWINGS

FIG. 1 is a perspective view of an arrow incorporating the teachings of the present invention;

FIG. 2 is a plan view of fletchings according to the invention taken at an intermediate stage of manufacture;

FIG. 3 is a plan view of a completed fletching in accordance with the invention;

FIG. 4 is a perspective view of an arrow in accordance with the invention during an intermediate step of assembly and illustrating a tool or jig for use in the simple custom assembly process;

FIG. 5 is a cross-sectional view of the shaft of an arrow according to the invention taken at line 5—5 of FIG. 1; and FIGS. 6A and 6B are plan views in elevation that illustrate the attachments of fletchings to arrow shafts for right and left handed archers, respectively.

DETAILED DESCRIPTION

Turning now to the drawings, FIG. 1 is a perspective view of an arrow 10 in accordance with the invention that includes a substantially cylindrical, elongated shaft 12. The shaft 12 may be one of a number of recognized compositions such as, for example, aluminum, wood or carbon. However, as will become apparent, supra, the invention most dramatically improves the performance of a light weight, high speed arrow of carbon or like composition.

The size of the shaft and the flight characteristics of the arrow 10 will vary in accordance with its material composition. A carbon shaft 12 for a competition-style arrow is typically of about 3/16 inch in diameter and weighs approximately 100 grains less than an aluminum (approximately 20–21/64 inch diameter shaft) or wood arrow (10–11/32 inch diameter shaft). The advent of high speed, carbon shaft arrows has been marked by suboptimal performances which the inventor has found to be, in large measure, attributable to the character of conventional arrow fletchings. The high-speed, light weight arrows have been found not to "group" as well as expected at long distances. Rather, the inventor has found that the crease between the vertical airfoil surface of the fletching and its mounting foot serves as a source of flutter which, at the longer shooting distances and flight times (typically 1.5 seconds) can build to the point that arrow stability is noticeably degraded.

The front end of the shaft 12 terminates in a point 14 while a nock 16 is fixed to its opposed or rearward end. A plurality of substantially planar fletchings 18 is fixed adjacent the shaft's rearward end.

FIG. 2 is a plan view of fletchings in accordance with the invention taken at an intermediate stage of manufacture. A plurality of fletchings 18 is formed by stamping a sheet 20 of polyester or similar high strength plastic to which an internally-positioned strip 22 of double-sided plastic tape has been fixed. By utilizing an adhesive of such composition, the fletchings 18 can readily be secured in a preferred manner to the shaft 12 without complex procedures. The ease with which the fletchings of the invention can be fitted to an arrow shaft permits the user to customize his arrow with regard to performance unencumbered by limitations imposed by the fixation process.

A standard jig is utilized to form the pairs of fletchings 18 symmetrically about the strip 22 that covers the double-sided adhesive tape. After stamping, a simple cutting tool can be employed to separate the fletchings in pairs along a central separation line 24 and to thereafter create individual fletchings by cutting along the transverse edge cut lines 26.

FIG. 3 is a detailed view of a completed (i.e. manufactured) fletching 18 prior to and in the process of fixation to an arrow shaft. As can be seen, the fletching 18 comprises distinct regions. A symmetrically curved vane 28 of arcuate shape forms a planar airfoil that terminates at a strip-like base 30 that is covered with double-sided tape 32. The basse 30 extends about ⅛ inch past the ends of the arcuate vane enhancing adhesion of the fletching 18 to the shaft 12. The tape 32 is exposed by peeling back the protective covering layer 22 that presents a non-adhesive surface for the user prior to fixation to the arrow. Once the layer 22 has been removed, the fletching is ready to be fixed to the shaft 12. The symmetrical shape of the vane 28 will be seen below to permit the customizing of the arrow for either a right or left handed archer with a single, standard fletching 18 and without extensive or complex installation procedures.

FIG. 4 is a perspective view of an arrow in accordance with the invention during an intermediate step of manufacture and illustrating a tool or jig 34 for use in the simple custom assembly process that is made possible by design. As mentioned earlier, a plurality of fletchings is fixed to the rear portion of the shaft 12 in the vicinity of the nock 16. The jig 34 comprises a planar disk having a central hole for accommodating the arrow shaft and includes equi-angularly spaced radial lines 36. As shown, the jig 34 is configured for affixing three fletchings 18 and, therefore, three radial lines 36 are spaced by 120 degrees. In the event that the archer desires to rig four fletchings 18, a similar jig would include four radial lines with an angular spacing of ninety (90) degrees.

It is well known that both the direction and speed of rotation of an arrow 10 will be affected by the angular orientations of the rear-mounted plurality of fletchings 18. An archer can easily and accurately adapt fletchings in accordance with the invention to the shaft 12 to achieve the desired speed and direction of rotation by first fitting the jig 34 to the arrow, then marking on the shaft 12 the points of intersection 38 of the radial lines 36 therewith. This assures three (or four) markings that are equally spaced about the shaft 12.

The archer then moves the disk-like jig 34 toward the front of the shaft 12 by the length of the base 30 of a fletching 18 to a position indicated as 34'. According to the direction and degree of arrow rotation desired, he then rotates the jig 34 as indicated by the two directions indicated at 40 to locate three equally spaced dots for positioning the front of the fletching 18. (Alternatively, in the event that the height of the base strip of the fletching provides sufficient cant, he may make the second set of markings without rotation of the jig 34 and simply align one set of dots 38 with the top and the other with the bottom edge of the fletching base). Following this procedure, the archer is readily able to fix the fletchings 18 in regularly spaced positions about the shaft 12 as indicated in FIG. 5, a cross-sectional view of the arrow 10 taken at the line 5—5 of FIG. 1. The degree of the mounting angle will effect the curvature of the mounted fletching. Such curvature will, in turn, effect the speed of rotation or spin of the arrow.

As noted in FIG. 5, each of the fletchings 18 is fixed to the shaft 12 by means of the double-sided adhesive tape 32. Furthermore, it is noted that each is mounted tangentially with respect to the shaft's periphery. As a result, the fletchings 18 are relatively stiff, as fitted to the arrow, containing no abrupt bends or creases (as mentioned, a gentle aerodynamic curvature is acquired by the otherwise-planar vane, through the mating of the base thereof to the curved surface of the shaft 12) as taught by the prior art fletchings which the inventor has found to produce a structure that is subject to flutter and consequent instability. By providing a fletching that, when fixed to the cylindrical shaft 12 acquires a strengthened, gently curved aerodynamic shape, the present invention provides an apparatus especially suitable for the advent of high speed, light weight arrows that are effectively "over controlled" by known fletching arrangements.

As mentioned earlier, the symmetrical shape of the accurate fletching vane of the present invention permits one to use a single geometry for both right and left handed shooters. FIGS. 6A and 6B are plan views in elevation that illustrate the attachments of fletchings to arrow shafts for right and left handed archers, respectively. As can be seen the edges of the fletching 18 are aligned with marks 38 that were determined in accordance with the tooling and procedures discussed with reference to FIG. 4. The symmetry of the arcuate vane of a fletchings 18 allows one to use the same fletching in either a right or left handed configuration. The method of fixture to the shaft is, as discussed above, quite simple due to the symmetrical fletching design. Furthermore, the vane 28 can be switched between a right and left handed configuration and vice versa by simply inverting the fletching 18 prior to fixation. In this way, the single side of the fletching base 30 that is covered with the double-sided adhesive MYLAR tape remains properly oriented toward the shaft 12. The extended ends of the fletching base optionally permit the user to place strips of tape about the shaft to protect the leading edge of peeling as a result of high speed of passage through a soft target.

The inventor has found that by utilizing such fletchings to assemble arrows in accordance with the invention, one may attain superior groupings of arrows of the carbon type at long target range due to improved control of otherwise de-stabilizing flutter. The superiority of the invention is most apparent at greater distances since the cumulative effects of flutter become greater with extended flight times. While this invention is particularly useful for adaptation to lightweight carbon arrows, it may be successfully employed with aluminum, wood and other heavier arrows when "scaled up". That is, such heavier and larger missiles will exhibit improved flutter performance when the fletchings described herein are enlarged and stiffened (through the use of 0.003 or 0.004 inch thick MYLAR), to provide more rugged and durable structures.

Thus it is seen that the present invention provides an improved arrow configuration. By employing the teachings in this invention, one can, among other things, realize the full potential of light weight, high speed carbon arrows without appreciable and flight-degrading flutter.

While this invention has been disclosed with reference to its presently preferred embodiment, it is not limited thereto. Rather, this invention is limited only insofar as defined by the following set of claims and includes within its scope all equivalents thereof.

What is claimed is:

1. An arrow comprising, in combination:

a) a substantially cylindrical shaft having front and rear ends;

b) a plurality of fletchings, each of said fletchings being mounted tangentially with respect to said shaft adjacent the rear end thereof;

c) each of said fletchings being of generally symmetrical arcuate shape extending from a substantially straight, strip-like base;

d) said strip-like base extending beyond said arcuate shape; and e) each of said fletchings including double-sided adhesive tape adjacent the base for fixture to said shaft.

2. An arrow as defined in claim 1 wherein each of said fletchings is of MYLAR and said adhesive tape is MYLAR adhesive tape.

* * * * *